US007011722B2

(12) United States Patent
Amtower, II

(10) Patent No.: US 7,011,722 B2
(45) Date of Patent: Mar. 14, 2006

(54) PROPELLANT FORMULATION

(75) Inventor: Paul K. Amtower, II, Keyser, WV (US)

(73) Assignee: Alliant Techsystems Inc., Edina, MN (US)

( * ) Notice: Subject to any disclaimer, the term of this patent is extended or adjusted under 35 U.S.C. 154(b) by 35 days.

(21) Appl. No.: 10/383,656

(22) Filed: Mar. 10, 2003

(65) Prior Publication Data

US 2004/0200553 A1 Oct. 14, 2004

(51) Int. Cl.
*C06B 29/22* (2006.01)

(52) U.S. Cl. ..... 149/76; 149/77

(58) Field of Classification Search ..... 149/76, 149/77

See application file for complete search history.

(56) References Cited

U.S. PATENT DOCUMENTS 3,651,008 A * 3/1972 Moser ..... 523/180
3,982,975 A * 9/1976 Elrick et al. ..... 149/19.9
4,012,462 A * 3/1977 Chaudhary ..... 525/243
4,411,717 A 10/1983 Anderson
4,493,741 A 1/1985 Ducote et al.
4,597,811 A 7/1986 Ducote
H717 H 12/1989 Stephens et al.
4,913,753 A 4/1990 Ducote
4,915,754 A 4/1990 Hightower, Jr. et al.
5,047,097 A 9/1991 Sayles
5,472,532 A 12/1995 Wallace, II
5,474,625 A 12/1995 Duong et al.
5,792,982 A 8/1998 Scheffee
5,872,328 A 2/1999 Menke et al.
6,086,692 A 7/2000 Hawkins et al.

* cited by examiner

*Primary Examiner*—Aileen Felton
(74) *Attorney, Agent, or Firm*—TraskBritt

(57) ABSTRACT

A solid heterogeneous, high performance rocket propellant, operable at high pressure with a burn rate relatively insensitive to changes in pressure and temperature, is disclosed. The propellant includes a binder formed from the reaction of a hydroxy terminated polybutadiene with a diisocyanate, ammonium perchlorate as an oxidizer, aluminum as a fuel, and iron oxide as a burn rate modifier. The ammonium perchlorate is a multimodal mixture of large paryticles with a weight mean diameter of about 70 to about 110 $\mu$m and small particles having a weight mean diameter of about 7.5 to about 15 $\mu$m. The propellant may also include bonding agents, curing catalysts, a plasticizer, antioxidant/peroxide scavengers, and pot life extenders.

23 Claims, No Drawings

PROPELLANT FORMULATION

FIELD OF THE INVENTION

The invention is directed to a solid, heterogeneous, high performance rocket propellant operable at high pressure with a burn rate relatively insensitive to changes in pressure and temperature. The propellant is comprised of large and small ammonium perchlorate particles, metal particles, binder, and iron oxide.

DESCRIPTION OF RELATED ART

Rocket motors operate by generating large amounts of hot gases from the combustion of a propellant stored in the motor casing. During operation, the gases generated from the combustion of the propellant accumulate within the combustion chamber until enough pressure is amassed within the casing to force the gases out of the casing and through the exhaust port. The expulsion of the gases from the rocket motor into the environment produces thrust.

Propellants are either solid or liquid. Solid propellants tend to be easier to utilize from a manufacturing and handling standpoint. Solid propellants are used extensively in the aerospace industry as the preferred means for powering most missiles and rockets for military, commercial and space applications.

Solid propellants fall into one of two categories. First, there are homogeneous solid propellants that contain fuel and oxidizer in a single molecule. Examples include nitrocellulose and nitroglycerin. Second, there are heterogeneous propellants that are generally in the form of a composite comprising an oxidizing agent, a fuel, and a binder. It is also known to add plasticizers, curing agents, cure catalysts, ballistic catalysts, and other additives to such heterogeneous compositions.

Ammonium perchlorate is often the oxidizer of choice in solid heterogeneous propellants. Ammonium perchlorate is added in particulate form. Propellants that contain ammonium perchlorate have been the backbone of the solid propulsion industry for almost fifty years.

Various metals, such as aluminum, zirconium, and magnesium, can be added to act as a fuel. These metals are flammable in powdered form. The function of the fuel component is to increase the flame temperature and generate hot metal particles for improved ignition.

In order to hold the propellant together, a binder is utilized. Known binders include polyurethanes, such as those based on the reaction product of hydroxyterminated polybutadiene ("HTPB") and a diisocyanate.

It is known to form a solid heterogeneous propellant from the combination of ammonium perchlorate, aluminum, and polyurethane. The following patents disclose such combinations: (1) U.S. Pat. No. 6,086,692; (2) U.S. Pat. No. 5,872,328; (3) U.S. Pat. No. 5,792,982; (4) U.S. Pat. No. 5,474,625; (5) U.S. Pat. No. 5,472,532; (6) U.S. Pat. No. 5,047,097; (7) U.S. Pat. No. 4,915,754; (8) U.S. Pat. No. 4,913,753; (9) U.S. Pat. No. 4,493,741; (10) U.S. Pat. No. 4,597,811; (11)4,411,717; and (12) H717.

When designing solid heterogeneous propellant formulations, it is necessary to carefully balance hardness with flexibility. This is especially true for propellants used in a Ballistic Trajectory Guided Munition ("BTGM"). A BTGM is defined herein as a projectile fired from a gun whose range is additionally boosted by firing an attached rocket motor.

The propellant must be sufficiently hard to prevent slumping, wherein the propellant is driven to the back of the motor casing during, for instance, ignition. This problem is even more pronounced in propellants used in BTGMs since the projectile is first fired from a gun. Pressures during firing rise as high as 10,000 psi.

Conversely, the propellant must be sufficiently elastic to avoid cracking. Once again, this problem is even more pronounced in propellants used in BTGMs since the projectile is first fired from a gun. If the propellant cracks, the exposed surface area in an affected cross section increases. When an affected cross section is ignited, more surface area burns than anticipated due to the presence of the crack. This results in a pressure spike within the casing. Pressure spikes cause erratic thrust and, when sufficiently high, burst the motor casing and cause rocket failure.

The propellant should have a high but steady burn rate that exhibits low pressure sensitivity. Once again, this is especially true for a propellant used in BTGMs, since the projectile is already moving when ignition occurs. A high bum rate (around 2.5 to 3.5 ips @ 10,000 psi) insures action time consistent with design requirements. The steady bum rate insures predictable thrust so that the casing does not burst and/or require excess reinforcement. "Pressure sensitivity," as used herein, is measured by a pressure exponent, i.e., the change in burn rate ("ips") over the change in pressure ("psi"). Conventional propellants are generally too pressure sensitive—exhibiting an exponential increase in burn rate at pressures substantially lower than 10,000 psi.

For the purposes of BTGMs, it would be desirable to develop a propellant that has a Young's modulus of about 450 psi to about 800 psi, a tensile strength range of about 70 psi to about 180 psi, and an elongation of greater than about 30%. Additionally, for the purposes of BTGMs, it would be desirable to develop a propellant that has a relatively constant pressure exponent (i.e., less than about 0.5 ips/psi) over pressures up to about 10,000 psi. Ideally, it would be desirable to develop a propellant that has a burn rate at about 10,000 psi of around 3 ips ±0.5. Burning rates may be obtained by any practical method including, but not limited to, burning strands and small-scale high pressure test motors.

The propellant should also be easy to process and handle. For instance, there should be sufficient pot life during production for the uncured propellant to be cast into a motor casing. In addition, since there is usually a long duration between the manufacture of a propellant and its use, the propellant should exhibit a long shelf life. Ideally, it would be desirable to develop a propellant that has a pot life of at least seven hours and a shelf life of at least five years.

BRIEF SUMMARY OF THE INVENTION

The invention is directed to a solid heterogeneous high performance rocket propellant operable at high pressures with a burn rate relatively insensitive to changes in pressure and temperature. The invention can be utilized in the motor of any rocket. However, the propellant is ideally suited for use as the propellant in BTGMs.

The propellant exhibits a Young's modulus in the range of about 450 psi to about 800 psi, a tensile strength in the range of about 70 psi to about 180 psi, and an elongation of at least about 30%. The propellant exhibits a pressure exponent that is less than about 0.5 ips/psi at pressures up to about 10,000 psi. Finally, the propellant exhibits a burn rate of around 3±0.5 ips at 10,000 psi.

The propellant is comprised of large and small ammonium perchlorate particles, metal particles, binder, and iron oxide.

Ammonium perchlorate functions as an oxidizer. In the instant invention, ammonium perchlorate is added in the form of a unique multimodal blend of at least two different types of particles. The first type consists of large, preferably rounded particles having a weight mean diameter in the range of about 70 μm to about 110 μm. The second type consists of small, preferably nonrounded particles, having a weight mean diameter of about 7.5 μm to about 15 μm. This multimodal combination of ammonium perchlorate particles provides optimum balance between exposed oxidizer surface area and packing fraction, both of which impact burn rate. Preferably, ammonium perchlorate is about 65 percent to about 95 percent of the weight of the propellant and the large and small particles are present in a ratio of from about 40/60 to about 60/40, respectively.

The metal particles are added as fuel. Preferably, aluminum is utilized, added in the form of fine particles, preferably with a weight mean diameter in the range of about 3 μm to about 10 μm. Preferably, the metal particles make up about 10 percent to about 20 percent of the weight of the propellant.

The binder, as the name implies, holds the composition together. The binder is formed by reacting in-situ a prepolymer with a curing agent. Preferred prepolymers include hydroxy functional prepolymers such as HTPB. Preferred curing agents for hydroxy functional prepolymers are multifunctional isocyanates. Preferably, the binder makes up about 7 percent to about 15 percent of the weight of the propellant. When isocyanate curing agents are used to cure a hydroxy functional prepolymer such as HTPB, the NCO/OH ratio between the two components is preferably in the range of from about 0.8 to about 1.2.

The iron oxide functions as a burn rate modifier. Accordingly, the amount of iron oxide directly impacts the ultimate burn rate. Preferably, iron oxide represents about 0.5 percent to about 3 percent of the weight of the propellant.

Cure catalysts, bonding agents, plasticizers and pot life extenders can be added, as needed, to facilitate processing. Antioxidant/peroxide scavengers can be added, as needed, to extend shelf life.

DETAILED DESCRIPTION OF THE INVENTION

The propellant of the present invention includes an ammonium perchlorate oxidizer, a metal particulate fuel, a binder and an iron oxide burn rate modifier. Cure catalysts, bonding agents, plasticizers and pot life extenders can be added to facilitate processing. Antioxidant/peroxide scavengers can be added to extend shelf life. The components are mixed, cast and cured.

A substantial component in the propellant is ammonium perchlorate. Ammonium perchlorate acts as the oxidizer in the composition. Although other oxidizers are known in the art, ammonium perchlorate is preferred due to its relatively high availability, relatively low cost, high energy, low hazards, ability to oxidize commonly available fuels, and variable burn rate.

Ammonium perchlorate is added to the propellant composition in particulate form. At least two types of ammonium perchlorate particles may be employed. The first type of particle is a rounded particle that has a weight mean diameter ranging from about 70 μm to about 110 μm, preferably about 85 μm to about 95 μm, ideally about 90 μm, as measured by a Coulter Counter or Microtrac device. By "rounded" it is meant that the particles are rotary rounded to insure a generally spherical shape. The second type of particle is a smaller less symmetrical particle, generally ground from 200 μm feedstock. The second particle ranges in weight mean diameter from about 5 μm to about 15 μm, preferably about 7.5 μm to about 12.5 μm, and is ideally about 10 μm. The two types of particles are preferably premixed prior to addition to the propellant composition. The particles are generally present in a large to small, particle ratio of about 40/60 to about 60/40, respectively. In one embodiment, a bimodal composition having approximately equal amounts of both types of ammonium perchlorate particles is employed.

Using two types of particles (aluminum and ammonium perchlorate) maximizes the impulse-density product obtained from the propellant. Specific impulse is the total force integrated over burning time per unit weight of propellant. Specific impulse ("$I_{sp}$") is calculated using the formula:

$$I_{sp}=Ft/mg$$

wherein "F" is thrust (N), "t" is time (s), "m" is propellant mass (kg) and "g" is the gravitational constant ($ms^{-2}$). Impulse density may be obtained by multiplying the specific impulse by the density of the resultant composition. By using a mixture of larger, rounded oxidizer particles, and smaller, rougher oxidizer particles along with smaller aluminum particles, a higher packing fraction is obtained. In other words, the smaller particles rest in the interstices between the larger particles. This maximizes the exposed oxidizer surface area per kilogram material and, thereby, the impulse density.

The ammonium perchlorate oxidizer represents more than half of the propellant's weight. Although there is a point of diminishing returns, increased oxidizer content generally increases the propellant's specific impulse. The total amount of oxidizer may range from about 65% to about 80%, by weight, of the propellant. More preferably, the oxidizer represents about 70% to about 75%, by weight, of the propellant. Ideally, the oxidizer agent is about 71%, by weight, of the propellant.

A metal fuel is added to increase the propellant's combustion temperature as well as the specific momentum of the escaping gases. Such metallic fuels include aluminum, magnesium, lithium, and boron. For economy, performance, and toxicity reasons, aluminum is the most preferred material.

The fuel may be added to the propellant in the form of very fine powders, i.e., particles having a weight mean diameter of about 3 μm to about 10 μm as measured by a Coulter Counter or Microtrac device. For instance, the particles may have a weight mean diameter of about 3 μm to about 5 μm. This particle size is unusually low for a metal fuel.

The fuel may represent anywhere from about 10 percent to about 20 percent of the weight of the propellant. Ideally, the fuel represents about 14% of the propellant.

The binder holds the propellant together and acts as an auxiliary fuel. Once cured, the binder makes the propellant flexible, which decreases the likelihood that the propellant will fracture under stress and pressure.

In the uncured state, the binder comprises at least two components. The first component is a liquid or semi-liquid prepolymer. The second component is a curing agent. Upon cure, the functional moieties on the curing agent react with functional moieties on the prepolymer to form crosslinks that harden the material.

Useful binders include those formed by reacting carboxy-terminated prepolymers with multifunctional imines or epoxides, as well as those formed by reacting hydroxyterminated prepolymers with multifunctional isocyanates. The binder may be formed from a polydiene prepolymer, e.g., a butadiene-acrylonitrile-acrylic acid terpolymer ("PBAN"), a HTPB, or a carboxy terminated polybutadiene ("CTPB").

The binder may be formed by reacting a HTPB prepolymer with a multifunctional isocyanate curing agent. Ideally, the HTPB prepolymer has an OH functionality of about 2 to about 3 and a specific average molecular weight less than about 10,000, preferably about 1000 to about 5,000, and more preferably about 3,000. Commercial and military grades of acceptable HTPB prepolymer include R45M and R45HT. The number "45" refers to the approximate number of diene units in the polymer chain. These products have a viscosity roughly similar to motor oil.

Hydroxy functional prepolymers, such as HTPB, are cured using multifunctional isocyanates. Curing agents suitable for use with the invention include hexamethylene diisocyanate ("HMDI"), isophorone diisocyanate ("IPDI"), toluene diisocyanate ("TDI"), trimethylxylene diisocyanate ("TMDI"), dimeryl diisocyanate ("DDI"), diphenylmethane diisocyanate ("MDI"), naphthalene diisocyanate ("NDI"), dianisidine diisocyanate ("DADI"), phenylene diisocyanate ("PDI"), xylene diisocyanate ("MXDI"), ethylenediisocyanate ("HDI"), other diisocyanates, triisocyanates, and polyfunctional isocyanates, and mixtures thereof. Preferably, the curing agent is IPDI, which is a less reactive isocyanate and, therefore, helpful to pot life.

Curing occurs when hydroxyl groups on the prepolymer react with isocyanate groups on the curing agent to form urethane crosslinks. Curing hardens the material. Given sufficient time, curing can occur at ambient temperature. However, curing is generally accelerated by the application of heat and/or pressure and also by cure catalyst.

In general, the prepolymer is from about 7% to about 15%, preferably about 8.5% of the weight of the propellant. The curing agent is then selected to insure the desired degree of crosslinking. For instance, when HTPB is employed, the isocyanate curing agent is added in an amount sufficient to generate a ratio of isocyanate groups to hydroxy groups ("NCO/OH") of about 0.80 to about 1.20, preferably about 0.85 to about 0.90. The curing agent is typically present in an amount greater than zero percent but no more than about 5 percent of the propellant's weight. Preferably, the curing agent is about 0.5 percent to about 1 percent of the propellant's weight. More preferably, the curing agent is about 0.6 percent of the propellant's weight.

Burn rate modifiers, or ballistic modifiers, accelerate or decelerate the combustion of the reaction as desired. In the instant invention, iron oxide was utilized as a burn rate modifier in the amount of about 0.5 percent to about 3.0 percent, and preferably in an amount of about 2.0 percent. The iron oxide, in this amount, reduces the ignition temperature, accelerates combustion, and keeps the pressure exponent less than about 0.5 ips/psi over ambient pressure to about 10,000 psi. A number of acceptable types of iron oxide are known in art, including red iron oxide and yellow iron oxide. Red iron oxide, however, is preferred.

Cure catalysts may or may not be present and can vary depending on the type of binder. Preferably, the cure catalyst is present in an amount representing anywhere from about 0.01 percent to about 0.25 percent of the weight of the binder. Ideally, the cure catalyst is about 0.015 percent of the weight of the binder.

For polyurethane bound systems, a good catalyst accelerates essentially the urethane reaction leaving side reactions, e.g., the water-isocyanate reaction, relatively unaffected. Suitable catalysts for forming polyurethane binders include, but are not limited to, the following: triphenyl bismuth ("TPB"), dibutyltin dilaurate ("DBTDL"), and the like, as well as mixtures thereof. The preferred catalyst is TPB.

A bonding agent may be added to reduce the viscosity of the mixture and increase the strength of the finished propellant. The bonding agent decreases the viscosity by evolving gas (e.g., ammonia) that breaks up the thick uncured propellant slurry, making it easier to process. The bonding agent increases the strength of the finished product by physically and chemically attaching the ammonium perchlorate to the binder.

A number of bonding agents are known and conventional. For instance, the bonding agents may be the polyamine bonding agents TEPANOL™ (i.e., a tetraethylenepentamine acrylonitrile glycidol reaction product) and TEPAN™ (i.e., a partially cyanoacrylated tetraethylenepentamine), both of which are commercially available products supplied by 3M.

TEPANOL™ and TEPAN™ are believed to become chemically linked to the polymeric propellant binder. TEPANOL™ and TEPAN™ also electrostatically coordinate with the aluminum perchlorate after forming a perchlorate salt from an acid/base reaction with aluminum perchlorate. Thus, TEPANOL™ and TEPAN™ aid in binding the aluminum perchlorate particles into the propellant matrix.

TEPANOL™ and TEPAN™ have a relatively basic pH, and in the presence of aluminum perchlorate, they produce a significant amount of ammonia. Thus, propellant mixing steps involving these bonding agents are carried out under vacuum in order to substantially remove the produced ammonia. Insufficient removal of the ammonia can result in soft cures and nonreproducible mechanical properties because the free ammonia reacts with some of the isocyanate curing agent and thus hinders consistent crosslinking.

Compositions containing TEPANOL™ and/or TEPAN™ are generally processed and cured at elevated temperatures, about 135° F. At ambient temperature, about 80° F., cure times can take as long as six to eight weeks.

Preferably, the bonding agent represents about 0.05 percent to about 0.15 percent of the weight of the propellant. More preferably, the bonding agent represents about 0.10 percent of the weight of the propellant.

In one embodiment, TEPANOL™ is the bonding agent. An acceptable commercial grade of TEPANOL™ is sold under the designation HX-878.

Plasticizers may be added to decrease viscosity and extend pot life. Any conventional plasticizer for rubber may be employed. For instance, the plasticizers may include dioctylsebacate ("DOS"), dioctyladipate ("DOA"), isodecylperlargonate ("IDP") dioctylphthalate ("DOP") and the like. In one embodiment, DOS is used as the plasticizer.

The plasticizer makes up no more than about 10 percent of the propellant's weight. For instance, the plasticizer is about 2.5 percent to about 4 percent of the propellant's weight. Ideally, the plasticizer is about 3.5 percent of the propellant's weight.

Pot life is defined herein as the time the propellant mixture remains sufficiently fluid to permit processing and casting into an appropriate vessel, e.g., a rocket motor chamber. For the purposes of flaw free casting, the propellant should maintain a viscosity less than about 5,000 poise for about 6 hours to about 8 hours.

Extremely catalytic materials, such as iron oxide in a urethane forming formulation, may reduce the actual pot life to less than one hour. Also, more reactive curing agents reduce pot life.

However, some materials, called "pot life extenders" delay the onset of cure and, thereby, extend pot life. For instance, maleic and oxalic acid retard or inhibit the catalysis of urethane reactions by cure inducing materials such as iron oxide without interfering with the function of cure catalysts such as TPB. These acids may be preblended with the curing agent prior to addition to prevent gassing in the propellant.

The present invention may also contain a pot life extender such as maleic anhydride. The pot life extender makes up about 0.005 percent to about 1 percent of the weight of the propellant. Ideally, the pot life extender makes up about 0.03 percent of the weight of the propellant.

Not all of the hydroxyl bonding sites in the prepolymer used to form the binder are exhausted during crosslinking. Accordingly, the propellants are subject to oxidative hardening and other contaminant reactions during storage. Antioxidants may be added to prevent oxidative hardening, which otherwise reduces the strain capability and increases the modulus of the propellant.

Suitable antioxidants may include 2,2-methylene-bis-4-methyl-tert -butylphenol), 2,2'-bis (4-methyl-6-tert-butylphenol), 4,4'-bis(4-methyl-6-tert-butylphenol), and the like, or mixtures thereof. In one embodiment, the antioxidant is 2,2-methylene-bis-(4-methyl-6-tert-butylphenol), which is commercially available as a product called AO-2246. Antioxidants are employed in the amount of about 0.1 percent to about 0.2 percent, by weight, of the propellant. Ideally, about 0.13 percent antioxidant is employed.

A distinct subset of antioxidants, which may be employed in addition to the general antioxidants specified above, are peroxide scavengers. Peroxide scavengers, as the name implies, react with peroxide contaminants in the system. The peroxide scavenger may be trinonylphenylphosphite, which is sold under the name POLYGARD® . Peroxide scavengers make up about 0.1 percent to about 0.2 percent, by weight, of the propellant and are added in combination with the antioxidants specified above. Ideally, about 0.13 percent peroxide scavenger is employed.

Antioxidant and peroxide scavengers increase the shelf life of the propellant multifold. A typical shelf life ranges from one year to ten years. Shelf life is an important property, especially in military applications, where weapons are generally procured and stockpiled long before use.

As stated, the ingredients of the propellant are admixed. Generally, mixing involves mechanically blending the components at elevated temperature. Preferably, mixing is conducted at a temperature of about 140° F. using mixing speed 10 on a 1-gallon Baker-Perkins planetary mixer. Certain mixing steps are conducted under vacuum to pull off volatiles, such as ammonia, if present.

The admixed ingredients are then added to the cast. Generally, the cast is a motor casing for a rocket. Casting should be done within the pot life of the propellant.

The cast propellant is then fully cured. Cure generally involves maintaining the cast propellant in a high temperature environment for an extended period of time. The curing is performed over the course of about 7 days to about 10 days at about 140° F.

An example of the propellant of the invention exhibits a Young's modulus of about 450 psi to about 800 psi, a tensile strength of about 70 psi to about 180 psi, and an elongation of at least about 30%. These measurements were obtained using an Instron testing machine. Conditions for the test were a strain rate of 0.74 in/in/minute, a test temperature at ambient (nominally 77° F.±10° F.) and a test pressure at atmospheric conditions. JANNAF class C dog bones were used. The propellant also exhibits a pressure exponent that is less than about 0.5 ips/psi at pressures up to about 10,000 psi. The pressure exponent was established with an optical strand bomb using ¼"×¼"×3" burn length strands and verified by high pressure 2"×4" right cylinder test motors. Finally, the propellant exhibits a burn rate of around 3±0.5 ips at 10,000 psi. The burn rate was also established using an optical strand bomb using ¼"×¼"×3" burn length strands and verified by high pressure 2"×4" right cylinder test motors.

The propellant of the invention can be used to propel any rocket. However, the propellant is ideally suited for, and specifically designed for, BTGMs, such as the Autonomous Naval Support Round ("ANSR"). In general, the ANSR is a 60 inch long, 5-inch diameter, gun launched, rocket assisted, guided projectile. However, the ANSR can be scaled down from a 5-inch diameter to any gun launch diameter including the AGS 155-mm size.

The ANSR uses a rolling airframe and ballistic trajectory to achieve a range greater than 50 nautical miles when fired from a standard Mk45, Mod 2 gun, and a range greater than 63 nautical miles when fired from the Mod 4 gun, in accordance with Naval Surface Fire Support ("NSFS") requirements. This is an improvement over current Navy gun launched projectiles which have a limited range of approximately 12 nautical miles. Thus, the ANSR extends the range of naval surface fire support, improving vessel survivability and increasing the number of shorelines where fire support may be provided.

The rocket motor for the ANSR is preferably positioned between the warhead section and the tail section, and assists the projectile's flight once it is positioned at least 2000 feet from gun launch. The rocket motor provides thrust to the projectile by burning approximately 30 pounds of the propellant made in accordance with the invention over an approximately 19 second period of time. The rocket motor containing the propellant of the invention provides the projectile with a sustained level of thrust throughout its motor burn time. The rocket motor is ignited using a rapid deflagration cord that is placed in contact with the initial burning surface of the propellant grain.

Propellants used in BTGMs, such as the ANSR, have many of the conventional propellant processing and handling requirements. However, the propellants must also be able to withstand the tremendous increase in heat, pressure and vibration caused when the projectile is initially fired from the gun. In addition, upon ignition, the propellant must burn with a sustained level of thrust. The present invention meets all of these requirements.

The following example further illustrates the invention:

EXAMPLE

A propellant mixture was prepared from the following components in the following amounts:

| INGREDIENT | WEIGHT % | GRAMS | ± |
|---|---|---|---|
| R45M | 8.503 | 382.65 | 1.00 |
| AO 2246 | 0.130 | 5.85 | 0.05 |
| Polygard | 0.130 | 5.85 | 0.05 |
| TPB | 0.015 | 0.675 | 0.05 |
| HX-878 | 0.100 | 4.50 | 0.05 |
| DOS | 3.470 | 156.15 | 0.50 |
| Al, H-3 | 14.000 | 630.0 | 1.10 |
| MA | 0.030 | 1.35 | 0.10 |
| Red Iron Oxide | 2.000 | 90.00 | 0.10 |
| AP 90 μm | 46.150 | 2076.8 | 4.00 |

-continued

| INGREDIENT | WEIGHT % | GRAMS | ± |
|---|---|---|---|
| AP 10 μm | 24.850 | 1118.3 | 3.00 |
| IPDI | 0.622 | 27.97 | 0.10 |
| TOTAL | 100.00 | 4500 | |

The solid content in the mixture is 87.03% (made up of the aluminum, maleic anhydride, red iron oxide, and ammonium perchlorate). The NCO/OH ratio between the isocyanate moieties on the IPDI to the hydroxyl moieties on the R45M is 0.870. The ratio of AP 90 μm particles to AP 10 μm particles is 1.9. The viscosity of the mixture at the end of mix+4 hours is 2–5 kP (as measured on a Haake viscometer using a 0.91 cup size). Less than 5 kP is desired. The mixture is prepared using the following steps:

R45M, DOS, HX-878, AO-2246, Polygard, and Al are mixed at 140° F., at mixer speed 10, for 25 minutes, at ambient pressure. "Mixer speed 10" means that the outer blade in a two blade Bakers-Perkins mixer makes ten complete revolutions per minute. HX-878 is left out at room temperature for 24 hours prior to mixing.

The resultant dust is wiped down to ensure incorporation of all solids.

35% of a blend of AP 90 μm particles and AP 10 μm particles is added to the mixture and admixed at 140° F., at mixer speed 10 for 10 minutes, at ambient pressure.

Another 25% of the AP blend is added to the mixture and admixed at 140° F., at mixer speed 10, for 15 minutes, at ambient pressure.

The admixture is vacuum mixed at 140° F., at mixer speed 10, for 30 minutes, at less than 15 mm Hg.

The resultant dust is wiped down.

Another 25% of the AP blend is then added to the mixture and admixed at 140° F., at mixer speed 10, for 10 minutes, at ambient pressure.

The remaining 15% of the AP blend is added to the mixture and admixed at 140° F., at mixer speed 10, for 15 minutes, at ambient pressure.

The mixture is vacuum mixed at 140° F., at mixer speed 10, for 45 minutes, at less than 15 mm Hg.

Red iron oxide is added to the mixture and admixed at 140° F., at mixer speed 10, for 5 minutes, at ambient pressure.

The resultant dust is wiped down.

IPDI TPB (dissolved in a minute amount of toluene), and MA (dissolved in a minute amount of acetone) is added to the mixture and admixed at 140° F., at mixer speed 10, for 5 minutes, at ambient pressure.

The mixture is vacuum mixed at 140° F., at mixer speed 10, for 20 minutes, at less than 15 mm Hg.

The vacuum is held at 140° F. for 60 minutes at less than 15 mm Hg.

A polyethylene carton is cast and held under vacuum at ambient temperature for 30 minutes at less than 15 mm Hg.

The mixture thus prepared is then poured slowly into a rocket motor and cured for 7 to 10 days at 140° F. The result is a solid heterogeneous propellant.

It will be appreciated to those skilled in the art that various modifications can be made to the invention as described above without departing from the spirit of the invention. Applicants claim right to the invention as defined below.

What is claimed is:

1. A propellant, comprising:

a binder formed in-situ by reacting a prepolymer and a curing agent;

ammonium perchlorate particles;

metal particles; and iron oxide, wherein the ammonium perchlorate particles are in a form of a multimodal mixture of rounded particles having a weight mean diameter of from about 70 μm to about 110 μm and of nonrounded particles having a weight mean diameter of from about 7.5 μm to about 15 μm.

2. The propellant of claim 1, wherein the binder is a polyurethane formed by reacting in-situ a hydroxy functional prepolymer and a multi-functional isocyanate curing agent.

3. The propellant of claim 2, wherein the hydroxy functional prepolymer is a hydroxy terminated polybutadiene having a hydroxy functionality of from about 2 to about 3 and a specific average molecular weight of less than about 10,000 and wherein the multi-functional isocyanate curing agent is a diisocyanate.

4. The propellant of claim 3, wherein the hydroxy functional prepolymer makes up from about 7 percent to about 15 percent of the weight of the propellant.

5. The propellant of claim 3, wherein the multi-functional isocyanate curing agent makes up a sufficient amount of the propellant so that the isocyanate/hydroxy ("NCO/OH") moiety ratio between the prepolymer and the multi-functional isocyanate curing agent is from about 0.8 to about 1.2.

6. The propellant of claim 1, wherein a weight ratio of rounded ammonium perchlorate particles to nonrounded ammonium perchlorate particles is from about 40/60 to about 60/40, respectively.

7. The propellant of claim 1, wherein the metal particles are aluminum particles that have a weight mean diameter of from about 3 μm to about 10 μm.

8. The propellant of claim 1, wherein the iron oxide provides from about 0.5 percent to about 3 percent of the weight of the propellant.

9. The propellant of claim 1, further comprising at least one of a bonding agent, a curing catalyst, a plasticizer, antioxidant/peroxide scavengers, and a pot life extender.

10. The propellant of claim 9, wherein the bonding agent is a reaction product of tetraethylenepentamine, acrylonitrile and glycidol.

11. The propellant of claim 9, wherein the binder is a polyurethane and wherein the curing catalyst is selected from the group consisting of triphenyl bismuth ("TPB"), dibutyltin dilaurate, and mixtures thereof.

12. The propellant of claim 9, wherein the plasticizer comprises dioctyl sebacate, dioctyl adipate ("DOA"), isodecyl perlargonate, dioctyl phthalate ("DOP"), or mixtures thereof.

13. The propellant of claim 9, wherein the antioxidant comprises 2,2-methylene-bis-(4-methyl-tert-butylphenol).

14. The propellant of claim 9, wherein the pot life extender is maleic anhydride.

15. The propellant of claim 1, wherein the propellant has a Young's modulus of from about 450 psi to about 800 psi, a tensile strength of from about 70 psi to about 180 psi, and an elongation of at least about 30%.

16. The propellant of claim 1, wherein a pressure exponent of the propellant is less than about 0.5 ips/psi at pressures up to about 10,000 psi.

17. The propellant of claim 1, wherein a burn rate of the propellant is about 3±0.5 ips at 10,000 psi.

18. The propellant of claim 1, wherein the propellant comprises the following components in the following amounts:

| COMPONENT | WEIGHT % |
|---|---|
| Binder | About 7 to about 15 |
| Antioxidant | About 0.1 to about 0.4 |
| Peroxide Scavenger | About 0.005 to about 0.2 |
| Curing Catalyst | About 0.01 to about 0.25 |
| Bonding Agent | About 0.05 to about 0.15 |
| Plasticizer | About 2.5 to about 4 |
| Pot Life Extender | About 0.01 to about 1 |
| Aluminum | About 10 to about 20 |
| Iron Oxide | About 0.5 to about 3 |
| Ammonium Perchlorate | About 65 to about 75 |
| Curing Agent | About 0.5 to about 5. |

19. The propellant of claim 1, wherein the propellant comprises the following components in the following amounts:

| INGREDIENT | WEIGHT % |
|---|---|
| Hydroxy-terminated Polybutadiene | About 8.503 |
| 2,2-methylene-bis-(4-methyl-tert-butylphenol) | About 0.130 |
| Trinonylphenyl phosphite | About 0.130 |
| Triphenyl Bismuth | About 0.015 |
| Reaction Product of Tetraethylenepentamine, Acrylonitrile, and Glycidol | About 0.100 |
| Dioctylsebacate | About 3.470 |
| Aluminum | About 14.000 |
| Maleic Anhydride | About 0.030 |
| Red Iron Oxide | About 2.000 |
| Aluminum Perchlorate (90 $\mu$m) | About 46.150 |
| Aluminum Perchlorate (10 $\mu$m) | About 24.850 |
| Isophorone Diisocyanate | About 0.622. |

20. A rocket motor comprising a rocket motor casing and a propellant in contact with the rocket motor casing, wherein the propellant comprises:

a binder formed in-situ by reacting a prepolymer and a curing agent;

ammonium perchlorate particles;

metal particles; and iron oxide, wherein the ammonium perchlorate particles are in a form of a multimodal mixture of rounded particles having a weight mean diameter of from about 70 $\mu$m to about 110 $\mu$m and of nonrounded particles having a weight mean diameter of from about 7.5 $\mu$m to about 15 $\mu$m.

21. A ballistic trajectory guided munition comprising a projectile having a rocket motor attached thereto, the rocket motor including a propellant in contact with a rocket motor casing, wherein the propellant comprises:

a binder formed in-situ by reacting a prepolymer and a curing agent;

ammonium perchlorate particles;

metal particles; and iron oxide, wherein the ammonium perchlorate particles are in a form of a multimodal mixture of rounded particles having a weight mean diameter of from about 70 $\mu$m to about 110 $\mu$m and of nonrounded particles having a weight mean diameter of from about 7.5 $\mu$m to about 15 $\mu$m.

22. The propellant of claim 1, wherein the ammonium perchlorate particles comprise from about 65 percent to about 95 percent of the weight of the propellant.

23. The propellant of claim 7, wherein the aluminum particles comprise from about 10 percent to about 20 percent of the weight of the propellant.

* * * * *